US007416478B2

(12) United States Patent
Vankouwenberg

(10) Patent No.: US 7,416,478 B2
(45) Date of Patent: Aug. 26, 2008

(54) PLANETARY DRIVE HEADS FOR GRINDING/POLISHING PADS

(76) Inventor: Raymond E. Vankouwenberg, 7 Sunleaf Dr., Penfield, NY (US) 14526

( * ) Notice: Subject to any disclaimer, the term of this patent is extended or adjusted under 35 U.S.C. 154(b) by 1 day.

(21) Appl. No.: 11/542,995

(22) Filed: Oct. 4, 2006

(65) Prior Publication Data

US 2007/0077873 A1 Apr. 5, 2007

Related U.S. Application Data

(60) Provisional application No. 60/724,217, filed on Oct. 5, 2005.

(51) Int. Cl.
*B24B 23/00* (2006.01)
*B24B 27/08* (2006.01)

(52) U.S. Cl. ..... 451/350; 451/351; 451/352; 451/353

(58) Field of Classification Search ..... 451/350, 451/351, 352, 353
See application file for complete search history.

(56) References Cited

U.S. PATENT DOCUMENTS

| | | | | |
|---|---|---|---|---|
| 862,747 | A | 8/1907 | Miller | |
| 4,097,950 | A | 7/1978 | Satterfield | |
| 4,182,001 | A | 1/1980 | Krause | |
| 5,170,595 | A | 12/1992 | Wiand | |
| 5,863,241 | A | 1/1999 | Rottschy | |
| 6,238,277 | B1 | 5/2001 | Duncan et al. | |
| 6,331,138 | B1 * | 12/2001 | Witters et al. | 451/340 |
| 6,540,596 | B1 | 4/2003 | Van Der Veen | |
| 6,595,838 | B1 | 7/2003 | Palushi et al. | |
| 6,616,517 | B2 | 9/2003 | Palushi | |
| 6,752,707 | B1 * | 6/2004 | Palushi | 451/350 |
| 7,140,957 | B2 * | 11/2006 | Thysell et al. | 451/350 |

FOREIGN PATENT DOCUMENTS

| | | |
|---|---|---|
| EP | 0 051 046 | 5/1982 |
| GB | 1286819 | 8/1972 |

* cited by examiner

*Primary Examiner*—Joseph J. Hail, III
*Assistant Examiner*—Shantese L. McDonald
(74) *Attorney, Agent, or Firm*—Hiscock & Barclay, LLP

(57) ABSTRACT

A planetary drive head for treating floors having a hub that rotates in one direction and attached media gears that rotate in the opposite direction.

18 Claims, 6 Drawing Sheets

PLANETARY DRIVE HEADS FOR GRINDING/POLISHING PADS

CROSS-REFERENCE TO RELATED APPLICATIONS

This application claims priority from U.S. Provisional Patent Application Ser. No. 60/724,217, filed Oct. 5, 2005, which is herein incorporated by reference.

FIELD OF THE INVENTION

This invention relates to drive heads for grinding, polishing, scrubbing, and burnishing apparatus.

BACKGROUND OF THE INVENTION

The apparatus used for sanding, polishing, grinding, or other floor treatment operations contain a drive mechanism, which, for example, could be an electric or a hydraulic motor. This drive mechanism causes a floor treatment disc to rotate or vibrate on the surface of the floor while the apparatus is guided across the surface to be treated either manually or as part of a ride-on vehicle.

Because of the force needed to operate the drive mechanism, a disadvantage of conventional floor treatment devices is that the force includes a strong sideward component during the operation, making controlled floor treatment possible by the operator's use of a sufficient counter force. Otherwise, the machine tends to pull to one side. In addition, there also is the resulting disadvantage that, because of dynamic forces, the perimeter of the floor treatment disc always tries to penetrate into the floor or surface, thereby representing a severe impediment when treating a softer floor surface, like wood or cork floors. A conventional floor treatment device, when placed in operation, will tend to wander from the starting position unless the operator remains vigilant and maintains control of the apparatus with sufficient counter-force.

There exists a number of U.S. patents directed to drive heads for grinding, polishing, and similar operations including U.S. Pat. No. 862,747 issued to Miller on Aug. 6, 1907. Miller teaches a drive head with a stationary central gear that is concentric with a head that is directly connected to a drive motor. Planetary gears, meshing with the central gear revolve about the center axis of the head as it rotates. Therefore, according to the disclosed configuration, the planetary gears rotate in the same direction as the head. Discs having the abrasive material are attached to the planetary gears and thus also rotate in the same direction as the head. This causes a sideways force on the machine and a noticeable pattern in the treated floor.

U.S. Pat. No. 6,752,707 issued to Palushi on Jun. 22, 2004 teaches a power sanding machine with three circumferentially spaced cogged belts to drive three discs that are rotatably mounted on an inner bowl. The inner bowl is rotatably mounted to a housing, which, in turn, is connected to an operating handle. The belts drive the discs in a direction opposite to the direction of the inner bowl. However, belts tend to be too weak to drive the discs at a rate high enough for grinding operations.

U.S. Pat. No. 5,863,241 issued to Rottschy on Jan. 26, 1999 teaches a floor sanding or polishing device including a housing that can be guided across a floor. The housing carries a motor which rotates a plate in a first direction about a vertical axis. The plate carries a plurality of sanding or polishing discs that are rotatable in the same second directions which are opposite to the first direction of rotation of the plate. The discs are displaceable radially relative to the plate by centrifugal force to bring a gear of the disc into engagement with a ring gear affixed to the housing, whereby the discs are rotated about their respective axes in response to rotation of the plate. Such outer ring gear drives, however, are vulnerable to damage.

A robust planetary drive head that can perform in polishing, grinding, and cleaning applications with reduced transverse forces is therefore desired.

SUMMARY OF THE INVENTION

The invention includes a planetary drive head for treating floors having a hub that rotates in one direction and attached media gears that rotate in the opposite direction. The drive head includes a first support means and a second support means rotatable independently of the first support means. A central gear is affixed to the first support means, a plurality of idler gears mesh with the central gear and are rotatably affixed to the second support means, and a drive gear meshes with each of the idler gears and is rotatably affixed to the second support means. The drive head also includes means for coupling at least one floor treatment medium to each of the drive gears.

In another form, the invention includes a planetary drive head for floor cleaning and resurfacing apparatus including means for attaching a plurality of floor treatment media to a drive head, means for rotating the drive head about a first axis in a first direction, and means for rotating the floor treatment media about a second axis in a second direction that is opposite to the first direction.

An advantage of the present invention is that the media pads are driven in the opposite direction to the bottom support means such that they revolve in one direction and rotate in the opposite direction. Such an orbital pattern is desirable because it avoids a strong sideways force exhibited by conventional machines, and it does not result in a noticeable pattern in the treated floor. A further advantage of the present invention is that the drive head does not use belts, but comprises strong gears that can drive the head at the speeds required for grinding hard floors, such as those made of concrete. An even further advantage of the present invention is that the drive head does not use a vulnerable outer ring gear to achieve the orbital grinding pattern.

BRIEF DESCRIPTION OF THE DRAWINGS

The above-mentioned and other features and advantages of this invention, and the manner of attaining them, will become apparent and be better understood by reference to the following description of several embodiments of the invention in conjunction with the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
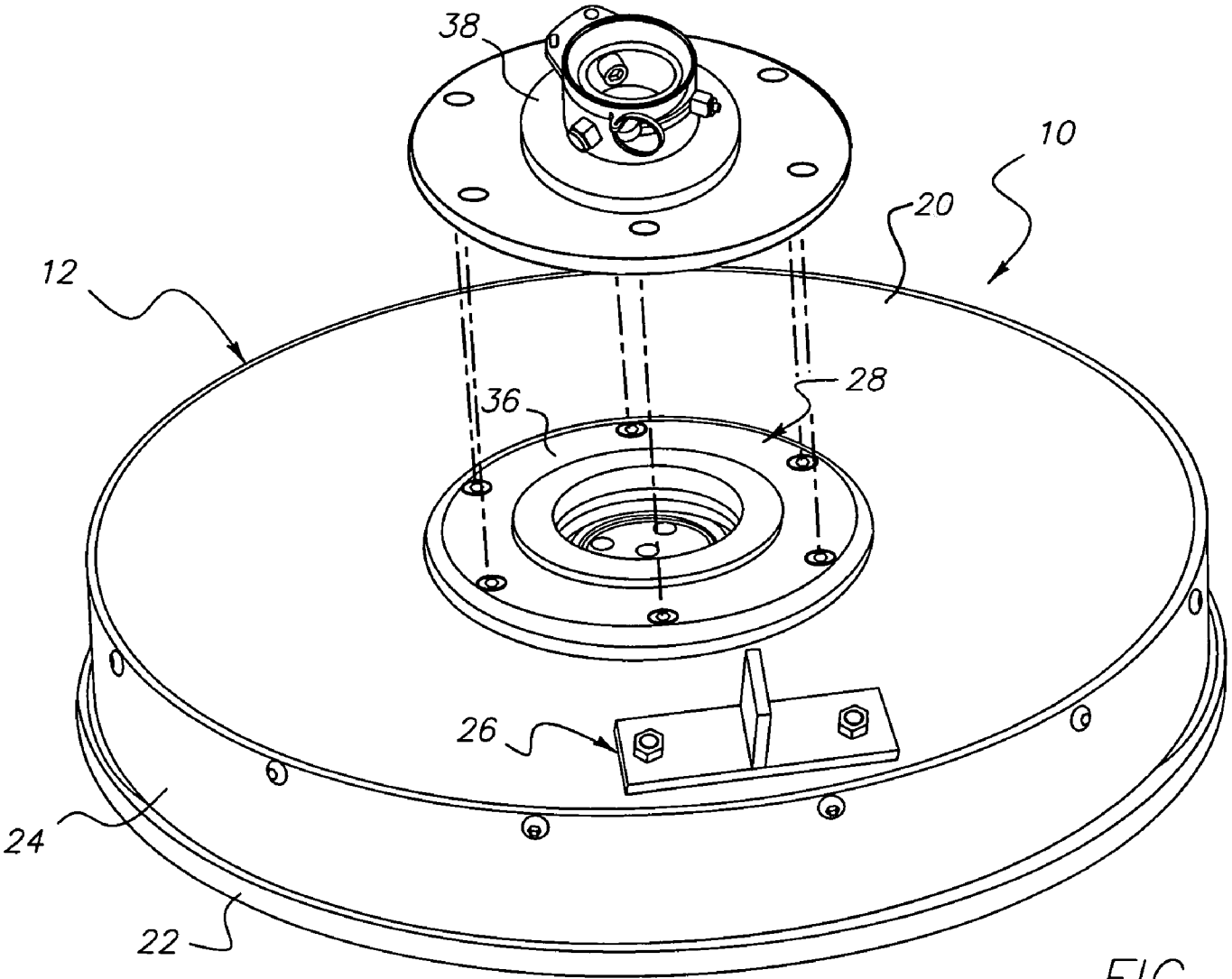
FIG. 1 is an isometric view of the planetary drive head of the present invention.

Referring to FIG. 1, there is shown the planetary drive head 10 of the present invention. The planetary drive head 10 includes a support structure 12, gears 14 (FIG. 2), and media supports 16 (FIG. 3).

The support structure 12, as illustrated and described, is in the form of a casing, which is advantageous because the casing protects the internal components from dirt and other contaminants that may affect the performance of gears and bearings. However, alternative support structures that may or may not protect the internal components are considered within the scope of the invention. According to the present embodiment, the support structure 12 includes a top casing 20, a bottom casing 22, and a circumferential sidewall 24. The sidewall 24 is bolted to the top casing 20 and fits slideably within a groove 25 in the bottom casing 22 so that the sidewall 24 does not interfere with the rotation of the bottom casing 22. A stop tab 26 is affixed to the top casing 20 and cooperates with the frame of the apparatus (not shown) to prevent the top casing 20 from rotating. A bottom hub 28, shown in FIGS. 3 and 4, includes a flange 30 that is affixed to the underside of the bottom casing 22. The bottom hub 28 further includes a flange 36 that extends over the top casing 20, as shown in FIG. 1. A top hub 34 (FIG. 5) encloses the bottom hub 28 with bushings, bearings, or both included between the top hub 34 and bottom hub 28 so that the bottom casing 22 and the bottom hub 28 may rotate independently from the top casing 20 and the top hub 34.

A quick coupler 38 is affixed to the flange 36 of the bottom hub 28 such that the quick coupler 38 rotates independently from the top hub 34. The quick coupler 38 may be similar to those described in co-pending application Ser. No. 11/111,114 (U.S. Publication Number 2005/0235453), which is herein incorporated by reference. However, alternative couplers may be used as well. The quick coupler 38 attaches to the drive shaft of a motor or hydraulic drive system (not shown) in order to provide support for the drive head 10 and in order to drive the rotation of the bottom hub 28 and the bottom casing 22.

Figure 2:
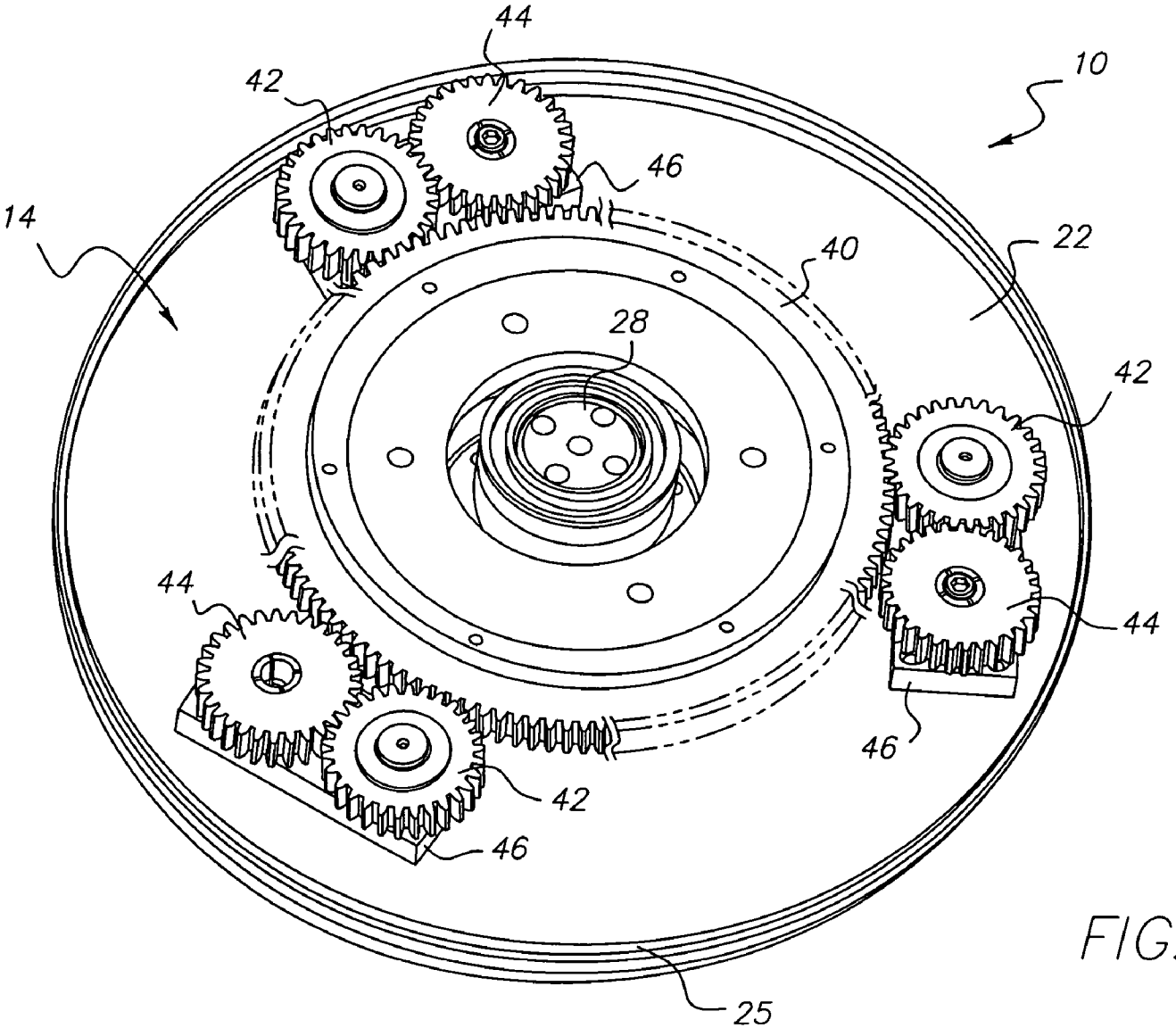
FIG. 2 is an isometric view of the planetary drive head with the top casing, the top hub, and the sidewall removed.
Figure 3:
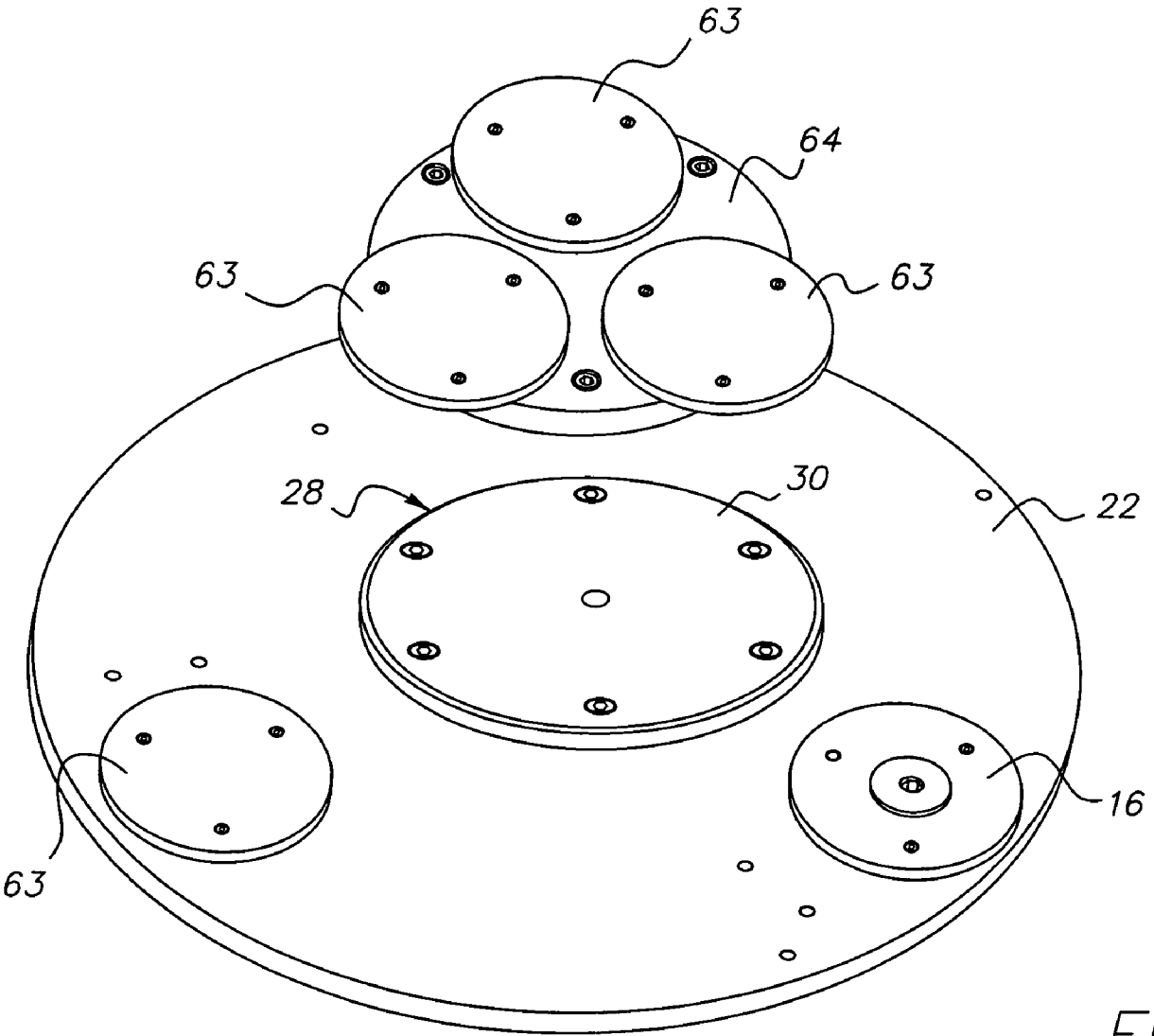
FIG. 3 is an isometric view of the bottom casing and media support flanges of FIG. 1.
Figure 4:
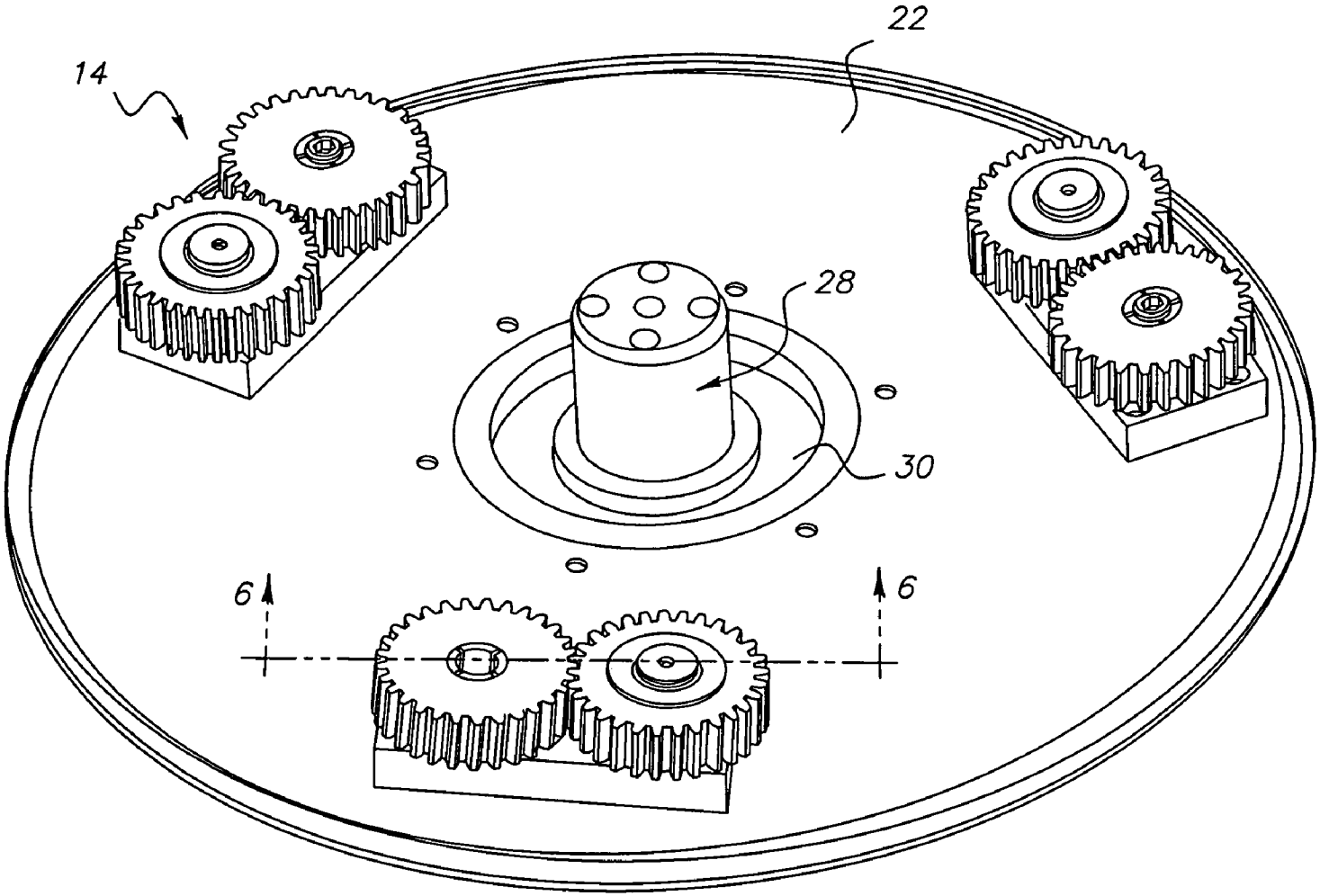
FIG. 4 is an isometric view of the bottom casing, the idler and drive gears, and the drive shaft of FIG. 2.
Figure 5:
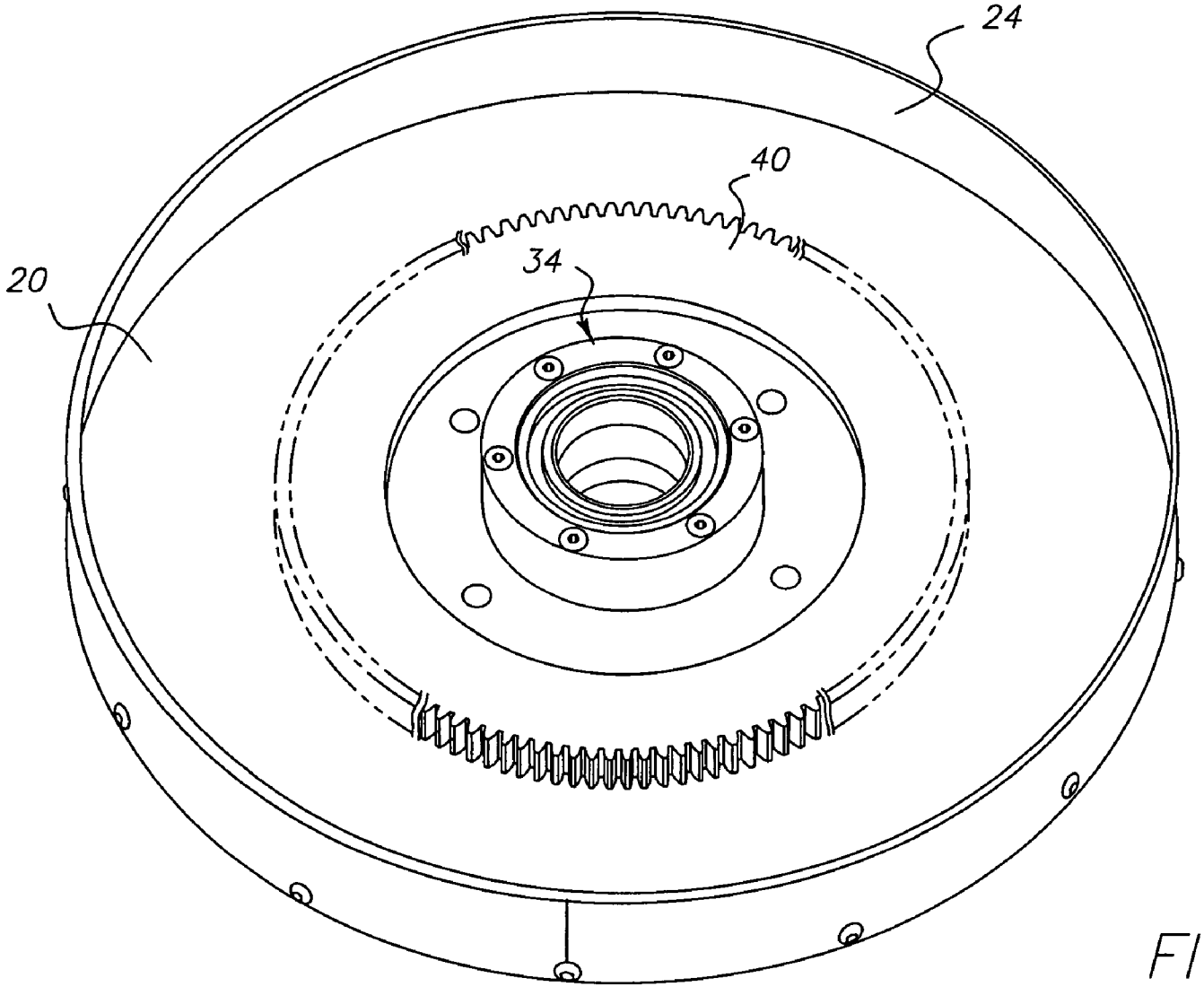
FIG. 5 is an isometric view of the top casing and central gear of FIG. 1.
Figure 6:
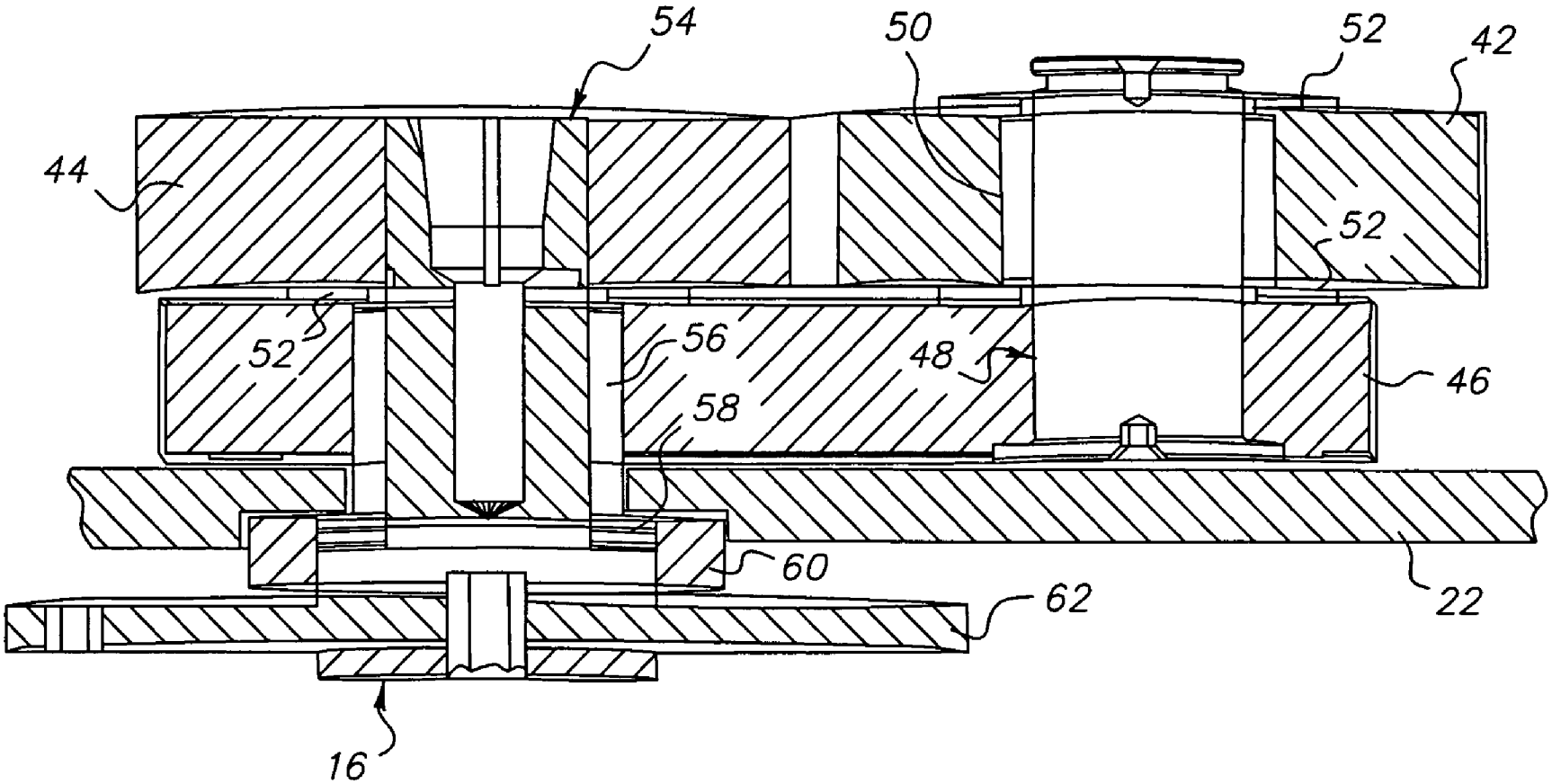
FIG. 6 is a cross-sectional view of the gears and spindles taken at line 6-6 of FIG. 4.

The gears 14, shown in FIG. 2, include a central gear 40, a plurality of idler gears 42 that mesh with the central gear 40, and a plurality of drive gears 44. Each of the drive gears 44 mesh with a single idler gear 42. As shown in FIG. 5, the central gear 40 is affixed to or integral with the top casing 20 so that as the top casing 20 is prevented from rotating by the stop tab 26 the central gear 40 is held stationary by the top casing 20. The idler gear 42, the drive gear 44, and their related components are best shown in FIGS. 4 and 6. A mounting block 46 is affixed to the bottom casing 22 and the idler gear 42 is affixed to the mounting block 46 via an idler gear spindle 48 and an idler gear needle bearing 50. Idler gear spacers 52 are included above and below the idler gear 42. The drive gear 44 is press fit onto a disc spindle 54. A disc spindle needle bearing 56 and a thrust bearing 58 allow the disc spindle 54 to rotate within the mounting block 46 and the bottom casing 22. A bearing spacer 52 is included between the drive gear 42 and the mounting block 46. A bottom seal 60 may be added to prevent the slurry and debris from the floor treatment process to penetrate the bottom casing 22.

The media support 16 (FIGS. 3 and 6) is affixed to or integral with the disc spindle 54 and includes a media flange 62 for receiving a media disc 63. The media disc 63 comprises a floor treatment medium and may be a plastic or metal disc impregnated with diamonds for grinding, a polishing material, a sanding material, or bristles, as in for a brush, among other things for treating floors. The media discs 63 are attached to the flange 62 by recessed fasteners, by a snap-connect system, or by a hook and loop fastening system, such as those sold under the trademark VELCRO. Further alternatives may also be imagined. The media disc 63 may be provided in various sizes and still be affixed to the same flange 62. For example, diamond impregnated discs are available in several sizes, however, the most common size tends to be about 3-in in diameter. A brush, on the other hand, might be about 8-in in diameter, for example.

In one embodiment, a media disc adaptor 64, shown in FIG. 3, is affixed to the flange 62 and a plurality of media discs 63 are then attached to the media disc adaptor 64. The planetary drive head 10 accommodates three media discs 63, as shown in the figures, although the planetary drive head 10 may be configured to have more or less media discs. However, when used in conjunction with the media disc adaptors 64, the number of media discs is multiplied. In this embodiment, the media discs 63 do not rotate about their local central axes; however, the media discs 63 are placed on the media disc adaptor 64 such that the media discs revolve about the central axis of the media disc adaptor 64. The media disc adaptor 64 rotates with the media supports in the opposite direction to the rotation of the bottom casing 22 resulting in an orbital pattern. In an example, the media disc adaptor 64 is 8-in in diameter and accommodates 4-in diameter diamond pads. Such a configuration can effectively turn a drive head with a 17-in diameter into one with a 22-in diameter.

In use, the planetary drive head 10 is attached to the drive mechanism via the quick coupler 38 and the media discs are attached to the media supports 16. The media discs are applied to the floor surface by a downward force, which may be achieved by a number of methods. For example, the downward force may be applied by a hydraulic actuator as described, for example, in co-pending U.S. patent application Ser. No. 11/111,114 (U.S. Publication Number 2005/0235453), or, alternatively, by the weight of the machine. In a further example, the downward force is adjustably applied by securing weights to the drive head. The drive mechanism rotates the quick coupler 38, which rotates the bottom hub 28. The bottom hub 28 rotates the bottom casing 22. The top casing 20 may tend to rotate with the bottom casing 22, except the stop tab 26 prevents the top casing 20 from rotating. The top hub 34 is coupled to the top casing 22 and therefore does not rotate. The bearings between the top hub 34 and the bottom hub 28 and the spacer between the top hub 34 and the bottom casing 22 allow the bottom casing 22, the bottom hub 28, and the quick coupler 38 to rotate independently of the top hub 34 and the top casing 22.

The central gear 40 is coupled to the top casing 20 and does not rotate; however, the idler gears 42 and the drive gears 44 rotate with the bottom casing 22. The idler gears 42 mesh with the central gear 40 and travel around its circumference as the bottom casing 22 rotates. Thus, each idler gear 42 is caused to rotate about its central axis in the same direction as the bottom casing 22 (e.g.: both clockwise). Each drive gear 44 meshes with an idler gear 42 and thus rotates about its central axis in the opposite direction as the bottom casing 22. Therefore, the media supports 16 and the media discs 63 rotate about the central axis of the planetary drive head 10 in a first direction and about the central axis of the media supports 16 in a second, opposite direction. This results in an orbital floor treatment pattern with counter centrifugal forces that effectively eliminate a sideward force.

In the alternative embodiment using the media disc adaptors 64, the media discs are attached to the media disc adaptors 64 and the media disc adaptors 64 are attached to the media supports 16. In this embodiment, each media disc adaptor 64 rotates with the media support 16 to which it is attached about the central axis of the media supports 16 in the direction opposite to the rotation of the bottom casing 22. The media discs 63 attached to each media disc adaptor 64 rotate about the central axis of the media supports 16, which may or may not coincide with the central axis of the media discs 63.

In one particular embodiment of the invention, the planetary drive head 10 is configured for a concrete floor grinding operation. The gear ratio between the central gear 40 and the idler gears 42 is about 4. In this embodiment, the gear ratio between the idler gears 42 and the drive gears 44 is 1. The drive mechanism is set to drive the bottom casing 22 at 190-rpm, 270-rpm, or 450-rpm. When set at 450-rpm, the idler gears 42 travel along the circumference of the central gear 40 at 450-rpm, which causes the idler gears 42 to rotate at about 1800-rpm about their central axes. The drive gears 44, and thus the disc spindles 54, the media supports 16, and the media discs 63, also rotate at about 1800-rpm. These parameters have also been shown to work well in brushing operations.

It should be noted that tendency of a floor treatment machine to pull in a direction that is transverse to the intended motion of the machine may be further reduced by the proper configuring of an even number of planetary drive heads 10. For example, two planetary drive heads 10 are connected to separate drive mechanisms on the same machine. The planetary drive heads 10 are substantially in a line transverse to the intended forward motion of the machine and the drive mechanisms rotate the bottom casings 22 in opposite directions. More particularly, the bottom casing 22 of the first planetary drive head 10 is rotated clockwise while the bottom casing 22 of the second planetary drive head 10 is rotated counterclockwise. When the drive mechanisms are driven at the same speed, any tendency of one planetary drive head 10 to pull in one direction is substantially cancelled out by the tendency of the other planetary drive head 10 to pull in the opposite direction.

It should be further noted that the planetary drive head 10 is particularly useful with the equipment described in copending U.S. patent application Ser. No. 11/111,114 (U.S. Publication Number 2005/0235453).

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

The invention claimed is:

1. A planetary drive head for floor cleaning and resurfacing apparatus, comprising:

a first support means and a second support means having a common axis, the second support means being rotatable independently of the first support means;

a central gear affixed to the first support means in alignment with the first support means axis;

means for preventing rotation of the central gear and the first support means;

a plurality of idler gears meshing with the central gear and rotatably affixed to the second support means at positions offset from the second support means axis;

a drive gear meshing with each of the idler gears and rotatably affixed to the second support means at positions offset from the second support means axis; and means for coupling at least one floor treatment medium to each of the drive gears.

2. The planetary drive head of claim 1, the floor treatment medium coupling means comprising a media support flange and a disc spindle coupled to each of the drive gears.

3. The planetary drive head of claim 2, each floor treatment medium being attached directly to one of the media support flanges.

4. The planetary drive head of claim 2, further comprising a media disc adaptor attached to each of the media support flanges and one or more of the floor treatment media being attached to each of the adaptors.

5. The planetary drive head of claim 1, wherein the floor treatment medium is in the form of a media disc, which comprises a material selected from the group consisting essentially of diamond impregnated metal, diamond impregnated plastic, polishing cloth, sandpaper, and bristles.

6. The planetary drive head of claim 1, the first support means comprising a top casing and the second support means comprising a bottom casing.

7. The planetary drive head of claim 6, further comprising a sidewall situated between the top casing and the bottom casing.

8. A planetary drive head for floor cleaning and resurfacing apparatus, comprising:

a first support means and a second support means rotatable independently of the first support means;

a central gear affixed to the first support means;

a plurality of idler gears meshing with the central gear and rotatably affixed to the second support means;

a drive ear meshing with each of the idler ears and rotatably affixed to the second support means;

means for coupling at least one floor treatment medium to each of the drive gears;

the first support means comprising a top casing and the second support means comprising a bottom casing; and a stop tab affixed to the top casing, the stop tab cooperating with a frame element to prevent the top casing from rotating.

9. The planetary drive head of claim 8, further comprising a top hub affixed to the top casing, a bottom hub affixed to the bottom casing, and a seal between each of the floor treatment medium coupling means and the bottom casing; a portion of the top hub surrounding a portion of the bottom hub with bearings situated between the portions allowing the bottom hub to rotate independently of the top hub.

10. The planetary drive head of claim 9, further comprising a quick coupler affixed to the bottom hub, the quick coupler being configured to connect to a receptacle on a drive mechanism.

11. A planetary drive head for floor cleaning and resurfacing apparatus, comprising:

a substantially non-rotating first support means and a rotatable second support means;

a substantially non-rotating central gear affixed to the first support means;

means for rotatably attaching a plurality of floor treatment media to the second support means;

means for rotating the second support means about a first axis in a first direction without rotating the first support means; and means operably engaging both the central gear and the media for rotating the floor treatment media about a second axis in a second direction that is opposite to the first direction.

12. The planetary drive head of claim 11, the floor treatment media attaching means comprising a plurality of media supports projecting through a bottom portion of the casing.

13. The planetary drive head of claim 11, the means for rotating the second support means comprising a drive mechanism coupled to the second support means to rotate the second support means in the first direction.

14. The planetary drive head of claim 13, the floor treatment media rotating means comprising a plurality of idler gears rotatably affixed to the second support means and meshing with the center gear, and a plurality of drive gears rotatably affixed to the second support means; each drive gear meshing with one of the idler gears and being coupled to a media support.

15. The planetary drive head of claim 14, each of the floor treatment media being attached directly to one of the media supports.

16. The planetary drive head of claim 14, further comprising a media adaptor affixed to each of the media supports, a plurality of floor treatment media being attached to each media adaptor.

17. The planetary drive head of claim 11, the floor treatment medium being in the form of a media disc that comprises a material selected from the group consisting essentially of diamond impregnated metal, diamond impregnated plastic, polishing cloth, sandpaper, and bristles.

18. A planetary drive head for floor cleaning and resurfacing apparatus, comprising:

means for attaching a plurality of floor treatment media to a drive head;

means for rotating the drive head about a first axis in a first direction;

means for rotating the floor treatment media about a second axis in a second direction that is opposite to the first direction;

the floor treatment media attaching means comprising a casing and a plurality of media supports projecting through a bottom portion of the casing; and a top hub affixed to a top portion of the casing, a bottom hub affixed to the bottom portion, and a seal between each of the media supports and the bottom portion; a portion of the top hub surrounding a portion of the bottom hub with bearings situated between the portions allowing the bottom hub to rotate independently of the top hub.

* * * * *